US010538906B2

(12) United States Patent
Nanayakkara

(10) Patent No.: US 10,538,906 B2
(45) **Date of Patent: *Jan. 21, 2020**

(54) COMPOSITE FLOOR JOIST

(71) Applicant: Pravin Nanayakkara, Boca Raton, FL (US)

(72) Inventor: Pravin Nanayakkara, Boca Raton, FL (US)

( * ) Notice: Subject to any disclaimer, the term of this patent is extended or adjusted under 35 U.S.C. 154(b) by 47 days.

This patent is subject to a terminal disclaimer.

(21) Appl. No.: 15/715,750

(22) Filed: Sep. 26, 2017

(65) Prior Publication Data

US 2019/0093335 A1 Mar. 28, 2019

(51) Int. Cl.

| | |
|---|---|
| ***E04B 1/16*** | (2006.01) |
| ***E04C 3/07*** | (2006.01) |
| *E04C 3/04* | (2006.01) |
| *E04B 1/24* | (2006.01) |

(52) U.S. Cl.

CPC ..... *E04B 1/165* (2013.01); *E04C 3/07* (2013.01); *E04B 2001/2448* (2013.01); *E04B 2001/2481* (2013.01); *E04C 2003/0473* (2013.01)

(58) Field of Classification Search

CPC ..... E04C 3/07; E04B 1/165; E04B 1/2403

USPC ..... 52/602

See application file for complete search history.

(56) References Cited

U.S. PATENT DOCUMENTS

| | | | | |
|---|---|---|---|---|
| 4,007,570 | A * | 2/1977 | Hunter | E04B 1/2403 52/317 |
| 4,685,264 | A * | 8/1987 | Landis | E04B 5/40 249/28 |
| 4,982,545 | A * | 1/1991 | Stromback | E04C 3/07 52/639 |
| 4,982,548 | A * | 1/1991 | Abbey | E04B 1/0007 403/232.1 |
| 5,188,479 | A * | 2/1993 | Nehls | E04B 1/2403 403/300 |
| 5,403,110 | A * | 4/1995 | Sammann | E04B 1/5831 403/205 |
| 5,414,972 | A * | 5/1995 | Ruiz | E04B 5/29 52/335 |
| 5,459,967 | A * | 10/1995 | Bodtker | E04B 7/00 182/82 |
| 8,141,318 | B2 * | 3/2012 | Dunbar | E04C 3/07 52/636 |
| 8,640,419 | B2 * | 2/2014 | Lee | E04C 3/44 52/649.2 |
| 8,661,754 | B2 * | 3/2014 | Hsu | E04B 5/40 52/289 |

(Continued)

*Primary Examiner* — Paola Agudelo

(74) *Attorney, Agent, or Firm* — Melvin K. Silverman

(57) ABSTRACT

A construction system definable in terms of an X, Y, and Z coordinate axes which provides a first part having a hollow three-walled web elongate in the Z axis, having a series series of securement brackets with geometric cut-outs on the upper Z edges of the elongate Z axis member; and a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support.

8 Claims, 9 Drawing Sheets

(56) References Cited

U.S. PATENT DOCUMENTS

| | | | | |
|---|---|---|---|---|
| 8,910,450 | B2 * | 12/2014 | Simon-Dominguez | E04G 11/44 52/742.14 |
| 9,803,351 | B2 * | 10/2017 | Ledford | E04C 3/07 |
| 2003/0089069 | A1 * | 5/2003 | Babich | E04B 1/2403 52/693 |
| 2006/0265992 | A1 * | 11/2006 | Hiragaki | E04B 1/2403 52/633 |
| 2014/0165499 | A1 * | 6/2014 | Vanker | E04C 3/07 52/834 |

* cited by examiner

COMPOSITE FLOOR JOIST

BACKGROUND OF THE INVENTION

The present invention relates to metallic surfaces of trapezoids of types used within frame of residential, commercial or industrial structures, and is an improvement of the invention of my U.S. Pat. No. 6,988,347, entitled Metal Stud Frame Element.

Historically frames of such structures were formed of steel and in the case of bearing structures; it was common to use a steel bar.

The use of vertical light gauge steel and studs, in lieu accomplish internal framing within a structure is also well known in the art. It is however not known to employ thin gauge vertical surfaces in combination with exterior wall framing in which vertical studs operate to define an offset the distance between an exterior and which is secured to one surface of such a steel surface.

A need for such surface steel gauges has arisen as a consequence of rapid on-site assembly high techniques employing thin external surfaces which have developed in the construction arts. The present invention therefore relates to such vertical metallic elements in which a one rectilinear surface thereof may operate as a process of an exterior surface, its base and/or load bearing resultant.

SUMMARY OF THE INVENTION

A construction system definable in terms of an X, Y, and Z coordinate axes which provides a first part having a hollow three-walled web elongate in the Z axis, a series of securement brackets on the upper edges of the elongate Z axis member and a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support.

Further provided is said series of securement brackets extending upwardly in a positive Y direction from said upper XZ base. Said series of securement brackets transfer shear force (shear flow) into the concrete it fixes to. The securement brackets have a space between each bracket, and said space between said securement brackets have a lower edge at the upper Z edge of the three-walled member. Additionally, said space between securement brackets have a lower edge part of the distance between the upper Z edge of the three-walled member and the upper edge of the series of securement brackets of the three-walled member. Said space between said securement brackets may be in a range of geometric shapes, including, circular, square, dovetail, rectangular, etc.

Yet further provided is, the first part having a hollow three-walled web having an open upper area and a lower XZ base along an elongate Z axis connected to two opposing walls of YZ planes.

Further provided is a series of substantially circumferential holes occurring toward the upper edges of the YZ web where said series of elements existing along the entire Z distance.

Yet further provided in the system is an XZ cross-section, which may be in the form of a trapezoid, inverted trapezoid, square, rectangle, or similar shape.

Additionally provided are possible structural supporting members attached to the lower XZ base, which may be in the form of a rod, such as a rebar, plate fastened to the surface of the base, such as a steel plate, with or without steel sidewalls, or ribs in the lower XZ base.

It is an object of the present invention to provide metallic structural elements which may be used in a vertical or horizontal capacity, including use within walls, floor, ceilings, and roofs.

It is yet another object to provide a three-walled elongate of the above type which can function as interior to exterior offsets.

It is accordingly an object of the invention to provide for both cast in place and pre-cast members to support concrete surfaces, such as a floor, roof, or wall.

It is yet another object to provide a three-walled member, capable of being rolled into shape, and cut to a desired length.

It is yet a further object to provide a multi-part system where a second part may complementally engage a first part, and allow the first part to be cut to a desired length as above.

The above and yet other objects and advantages of the invention will become apparent from the hereinafter set forth Brief Description of the Drawings, Detailed Description of the Invention, and Claims appended herewith.

DETAILED DESCRIPTION OF THE INVENTION

Figure 1:
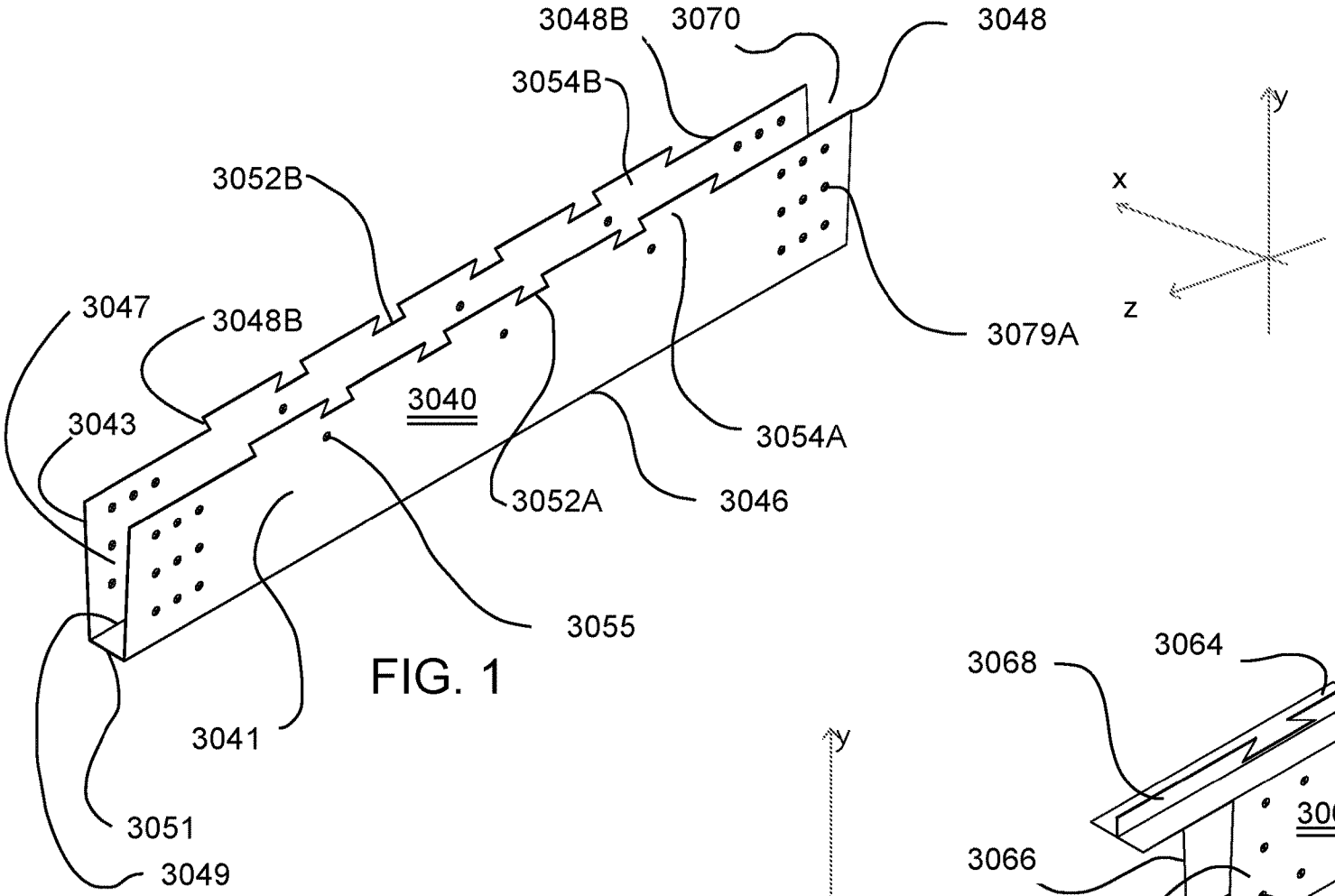
FIG. 1 is a perspective view of a first part of the system.
Figure 2:
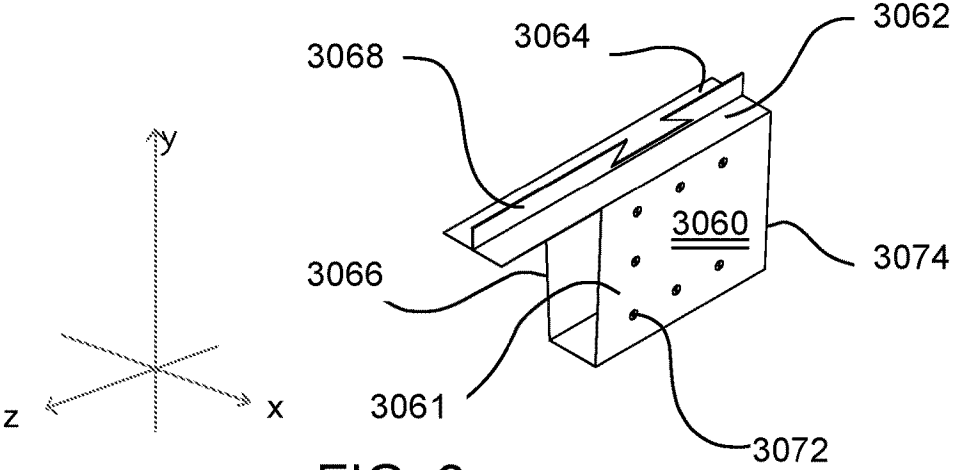
FIG. 2 is a perspective view of a second part of the system of FIG. 1.

There is provided a construction system which provides terms of an X, Y and Z coordinate system, this particularly as is shown with FIGS. 1 and 2 herewith.

Figure 16:
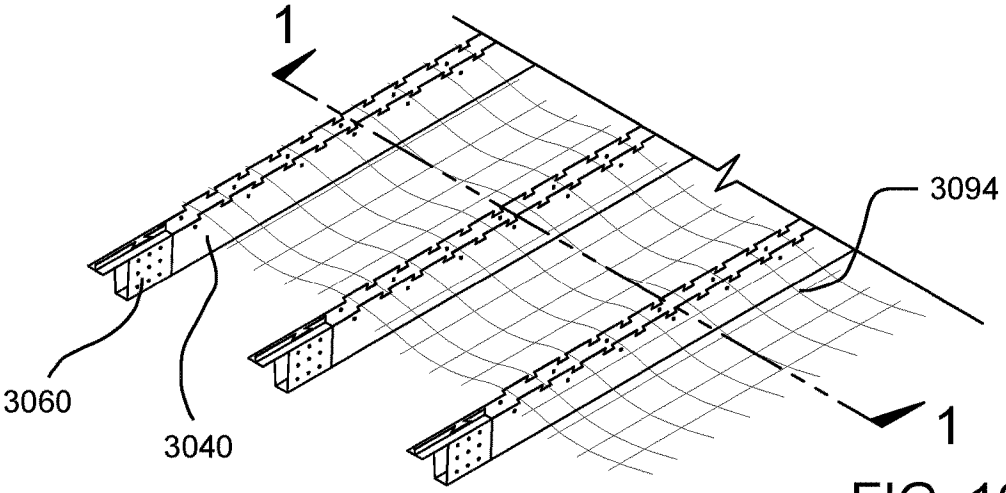
FIG. 16 is a perspective view of multiple members in the system.
Figure 17:
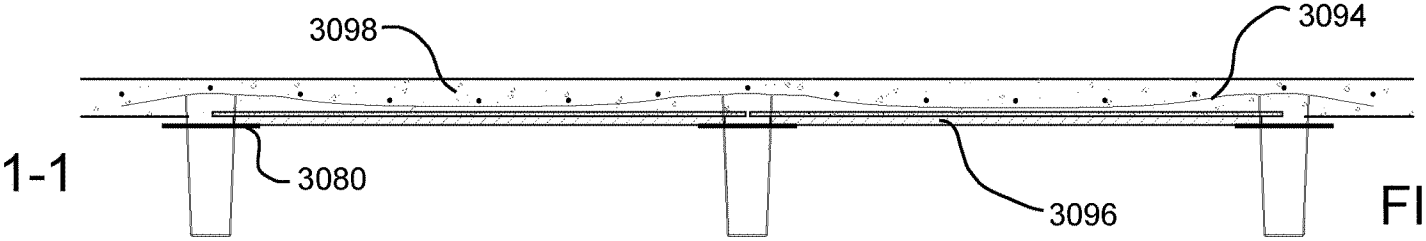
FIG. 17 is an XY cross sectional view of the system of FIG. 16 with form-board.
Figure 18:
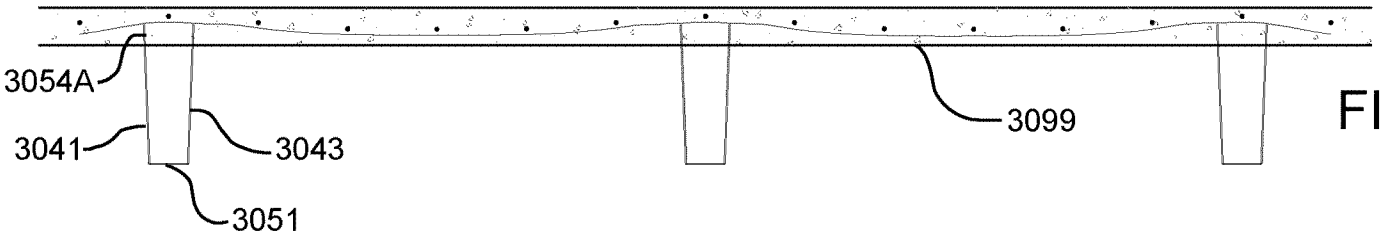
FIG. 18 is an additional XY cross sectional view of the system of FIG. 17 with form-board removed.

The system may be used in a horizontal orientation in use, for example, with flooring, ceilings, or roofing, and may be produced using material, such as steel, fiber glass, carbon fiber, etc. The system may also be used vertically, for example, in wall construction. One may secure the members 3040 and 3060 in use with concrete or similar material by fitting an opening 3074 of a second part of the system 3060 over a cross-sectional end 3047 of a first part of the system 3040 at each distal end, and casting the concrete in place as shown in FIGS. 16-18 over the series of securement brackets 3054A and 3054B. A securing member 3080, may pass through the members to hold up a material thereof supporting said concrete for cast-in-place uses as shown in FIG. 17. The system may also use pre-casting, where the members are cast upside down until the concrete hardens, then flipped over and put in to place. Said series of securement brackets 3054A and 3054B transfer shear force (shear flow) into the concrete it fixes to.

Figure 19:
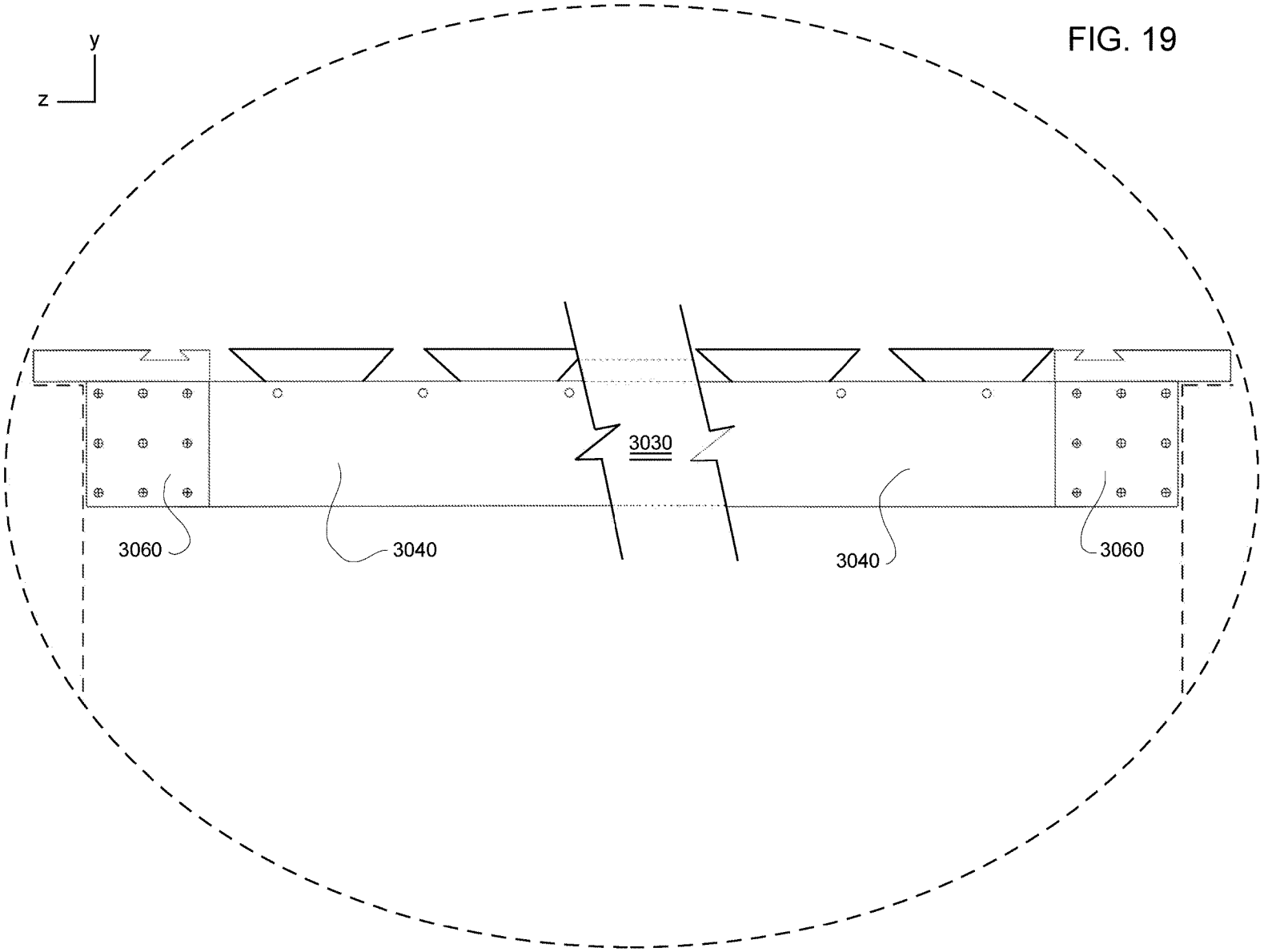
FIG. 19 is an YZ side elevation depicting the full joist of the system.

In other words, end members 3060 are placed at each end of the three-walled member. The end member 3060 allows the joists 3030, made up of the first part 3040 and second part 3060, as shown in FIG. 19, to sit on the surface of a structural support, such as a pier, beam, joist, stud, or wall. Once joist members 3030 are placed into their location, a form-work support pin 3080 is placed, and form board 3096 is placed on top of the pins. See FIG. 17. From there a wire mesh 3094 is laid on top of the form board 3096, as shown in FIGS. 16 and 17. From there, concrete 3098 is poured over top of the form board, and once hardened, the pins 3080 can be removed and the form board 3096 lowered, exposing the newly hardened concrete lower surface 3099, as seen in FIG. 18, Supported by the three-walled members.

While the present system may be used for cast in place construction as mentioned above, this embodiment is best enabled for a pre-cast system. This is because the system has an open upper XZ plane 3070, as seen in FIG. 1. In an effort to keep the concrete from filling in the member through the upper XZ plane opening 3070, the joist members 3030 of a first part 3040 and a second part 3060, are best suited to have a securement bracket 3054A/3054B secured in to concrete 2098 upside down, then flipped over into a position once the concrete is hardened, similar to FIG. 18.

In FIG. 1 is seen sidewall 3041, on a YZ plane, between edges 3046 of a lower XZ base and upper edge 3048. Edges 3046 and 3049 define the lower four-sided XZ base 3051.

Further shown in FIG. 1, is a series of substantially circumferential holes 3055 occurring toward the upper edges of the YZ web where said series of holes exist along the entire Z distance. These holes 3055 are used in the placement of a form pin 3080, which can be further seen in FIG. 17.

Figure 6:
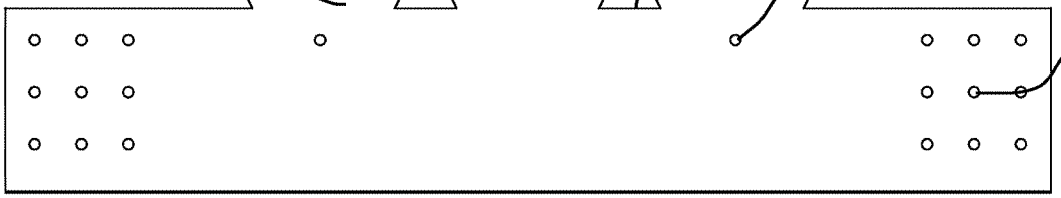
FIG. 6 is a YZ elevation view of the system in FIG. 5

An upper opening 3070 extending in a Z axis can be seen in FIGS. 1 and 6. As may also be seen in FIGS. 1 and 6, at the upper edges 3048/3048B, is a series of securement brackets 3054A/3054B extend in the positive Y direction of the YZ walls 3041 and 3043.

In an ideal manufacture, the member 3040 will begin as a continuous solid sheet of metal, and will be rolled into for on a continuous machine, allowing members to be cut into varying lengths.

FIG. 2 is the second part of the system. The member 3060 of the second part slip-fits over the member 3040 of a first part. The member of the second part 3060 is of the same proportions of the first part with a slightly larger cross-section to allow the cross sectional opening 3047 of the first part to slide in to the opening 3074 of the second part. Sidewall 3061 of the second part abuts the outside of sidewall 3041 of the first part. Sidewall 3066 abuts sidewall 3043. Lower XZ base 3072 of the second part abuts the underside of lower XZ base 3051 of the first part. Areas for screws 3079 exist on the sidewalls if the second part of the system, and complement area 3079A on the first part of the system. Screws allow the first part of the system to fasten to the second part of the system.

Figure 3:
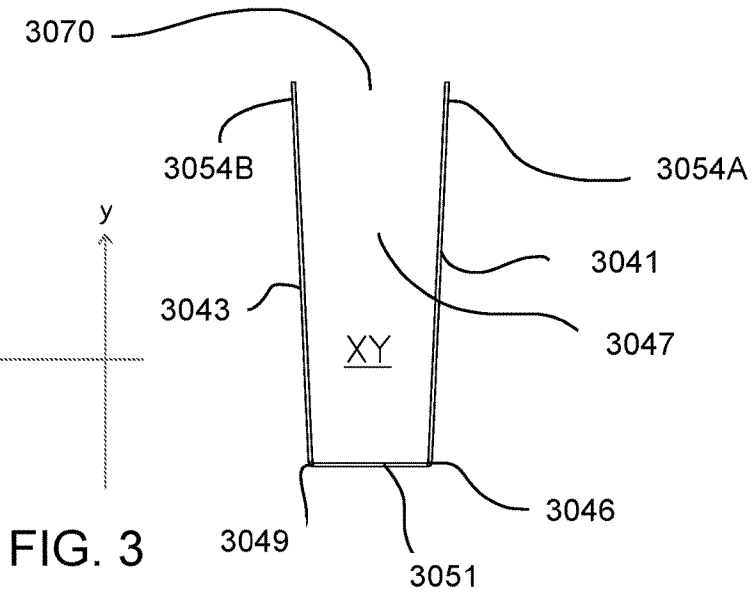
FIG. 3 is an XY cross-sectional view of FIG. 4 at 3-3
Figure 3A:
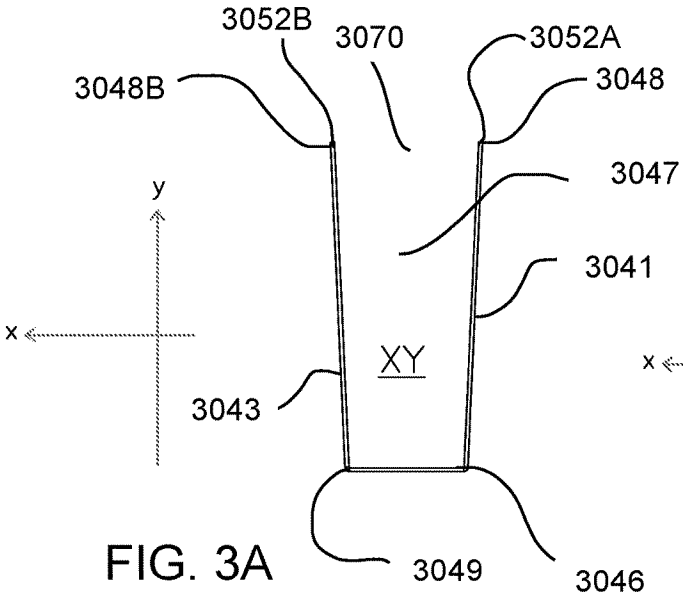
FIG. 3A is an XY cross-sectional view of FIG. 4 at 3A-3A
Figure 4:
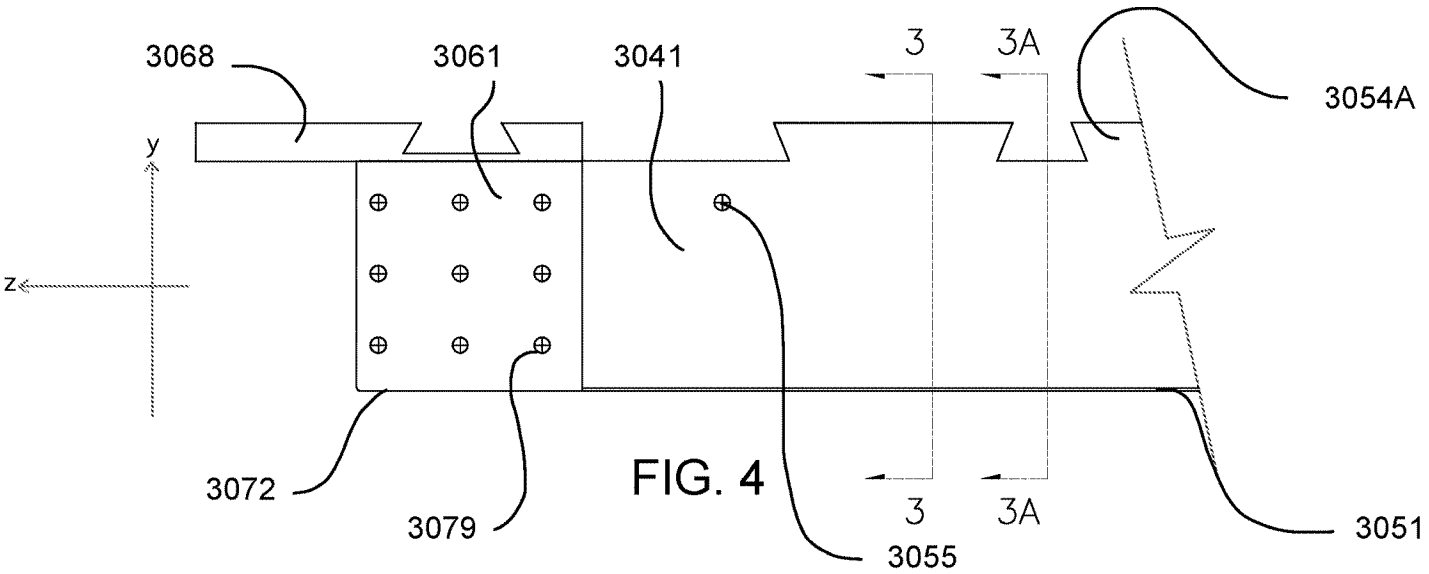
FIG. 4 is a side elevation depicting the insertion of the first part within a second part of the system.

FIGS. 3 and 3A shows a cross-sections of FIG. 4 of the first part of the member. Noticed in FIG. 3. are YZ sidewalls 3043 and 3041, and lower XZ base 3051. Also shown are securement brackets 3054A/3056A. FIG. 3A shows YZ sidewalls 3043 and 3041, upper edges 3048 and 3048B and lower XZ base 3051.

FIG. 4 shows an XZ side elevation of the first and second part of the system of FIGS. 1 and 2, respectively, engaged in a position where the second part is fitted over the first part of the system.

Figure 5:
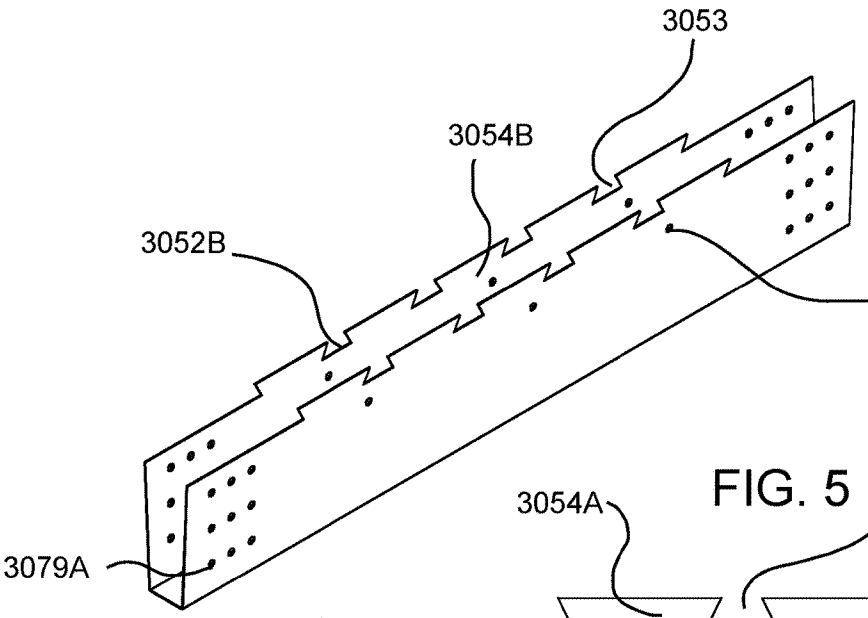
FIG. 5 is an additional perspective view of a first part of the system.

FIG. 5 is a view similar to that of FIG. 1, focusing on the securement brackets 3054B/3056B, the space 3053 between them, and the lower edge 3052 of the space 3053 thereof. Said space between said series of securement brackets may be in a range of geometric shapes, including: circular, square, dovetail, rectangular, etc.

FIG. 6 shows a side elevation of the first part of the system, including views of the series of securement brackets 3054A, lower edge 3052A of the space 3053 between the series of securement brackets 3054A, holes 3055, and screw areas 3079A.

Figure 7:
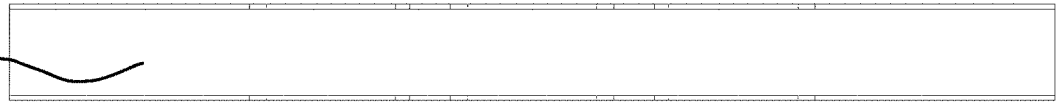
FIG. 7 is an XZ top view of the system in FIG. 5

FIG. 7 shows a top view of the first part of the system, looking down. This view includes a view of the lower XZ base 3051.

There is provided a second embodiment of a construction system provided in terms of an X, Y, and Z coordinate system. This is particularly shown in FIGS. 8-10.

The primary differences from the first embodiment to the second embodiment are the nature of the securement brackets 3054A/3054B and 3154A/3154B. The primary differences from the first embodiment to the second embodiment are the nature of the securement brackets 3054A/3054B and 3154A/3154B. As may be seen in the second embodiment, the securement brackets 3154A/3154B occur in an inverse alternation between one side as compared to another. Noticed in the first embodiment are the securement brackets 3054A/3054B occurring in a mirror orientation of that of the opposing side. Stated another way, in the first embodiment, a securement bracket 3054A of one side will mirror a securement bracket 3054B of an opposing side, while a securement bracket 3154A in the second embodiment will mirror a space 3053B of an opposing side. See FIGS. 5-7 as compared with FIGS. 8-10 respectively.

Figure 8:
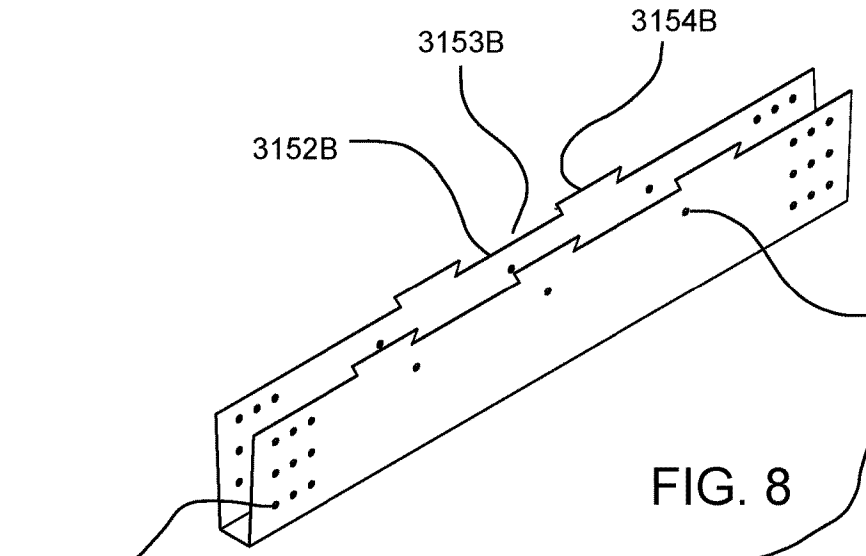
FIG. 8 is a perspective view of a second embodiment of the first part of the system.

FIG. 8 is a view similar to that of FIG. 5, focusing on the series of series of securement brackets 3154B, the space 3153B between them, and the lower edge 3152B of the space 3153B thereof. Said space between said securement brackets may be in a range of geometric shapes, including, circular, square, dovetail, rectangular, etc.

Figure 9:
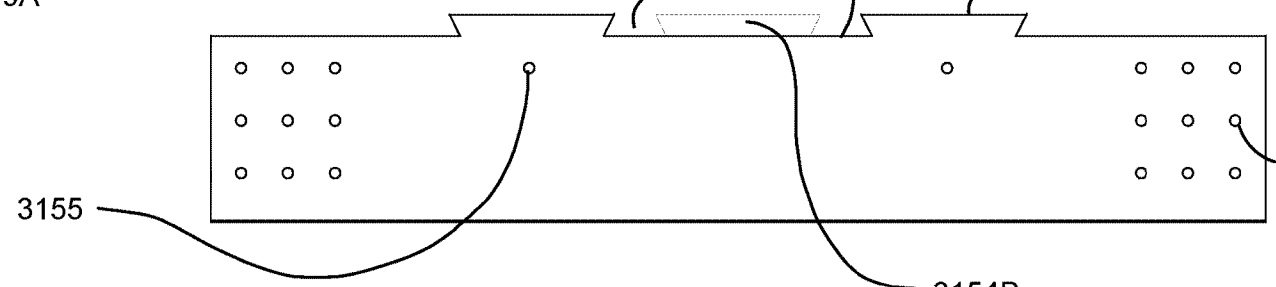
FIG. 9 is a YZ side elevation of the second embodiment of the first part of the system.

FIG. 9 shows a side elevation of the first part of the system, including views of series of securement brackets 3154A, lower edge 3152A of space 3153A between said securement brackets 3154A, holes 3055, and screw areas 3079A.

Figure 10:
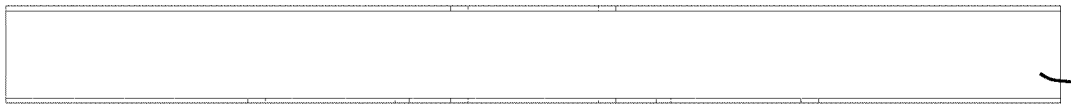
FIG. 10 is an XZ top view of the system of FIG. 8.

FIG. 10 shows a top view of the first part of the system of the second embodiment, looking down. This view includes a view of the lower XZ base 3151.

Figure 11:
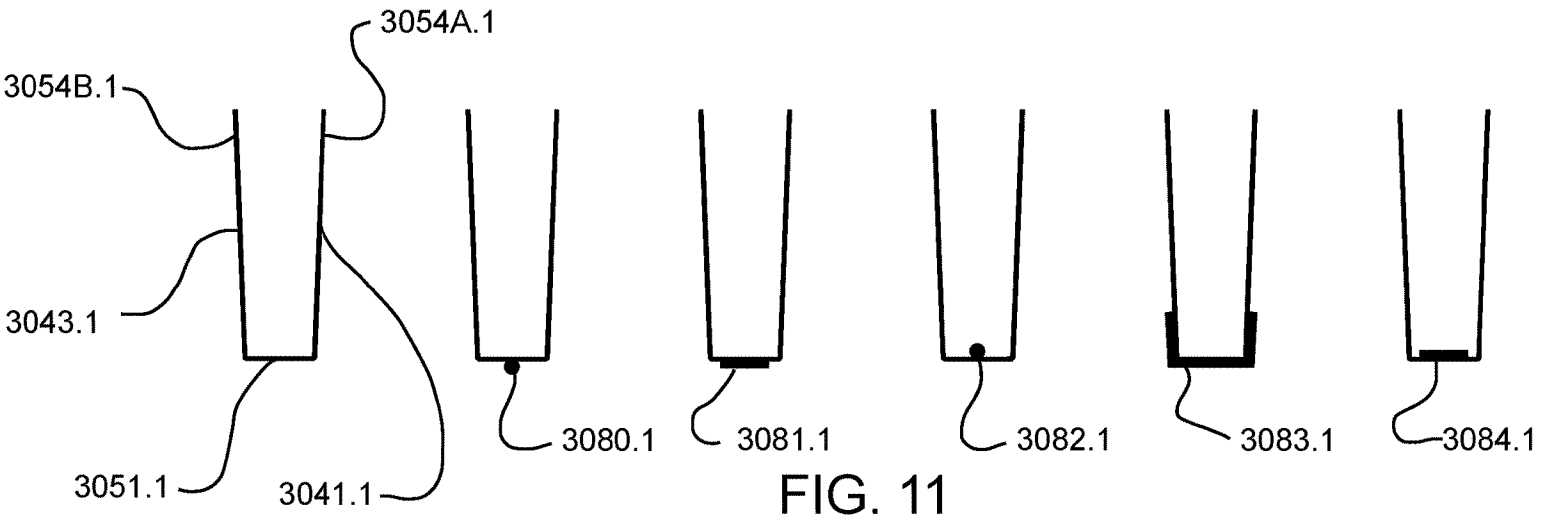
FIG. 11 show XY trapezoidal cross-sections of the system.
Figure 12:
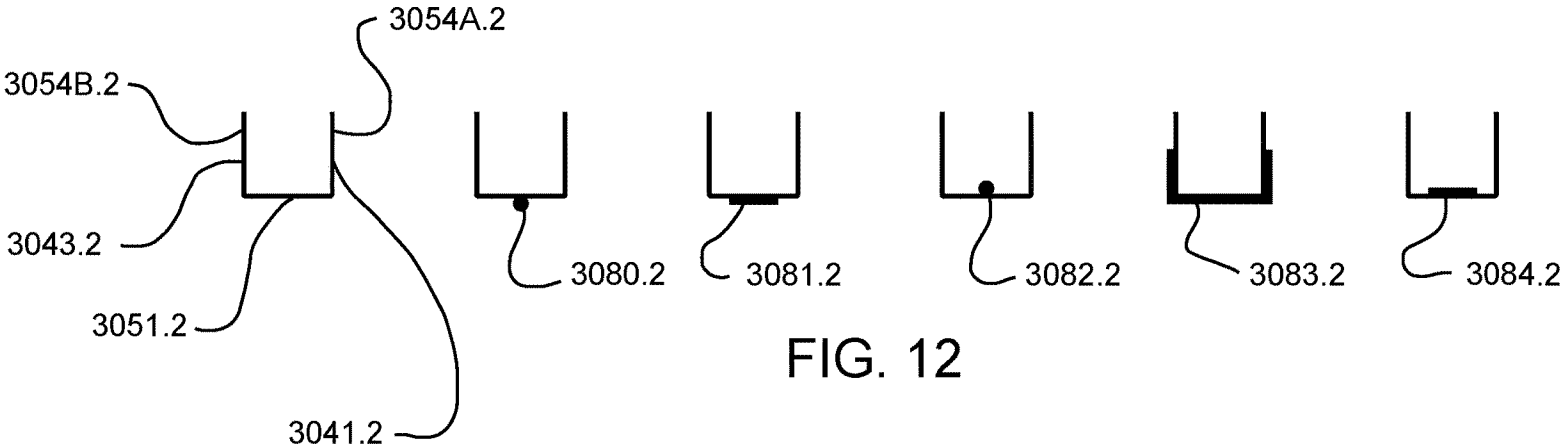
FIG. 12 shows XY square cross-sections of the system.
Figure 13:
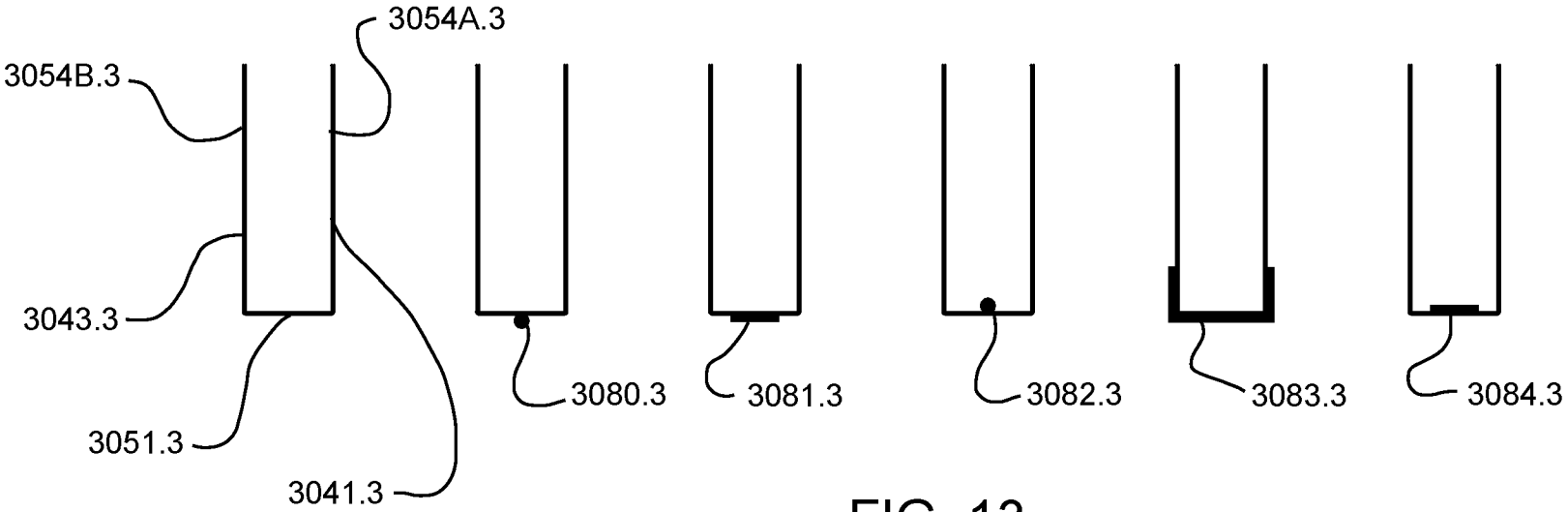
FIG. 13 shows XY rectangular cross-sections of the system.
Figure 14:
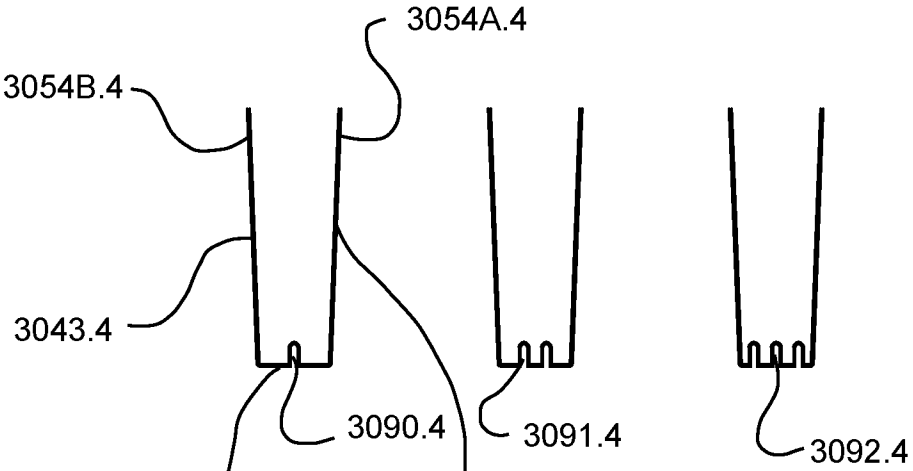
FIG. 14 shows other trapezoidal cross-sections of the system.
Figure 15:
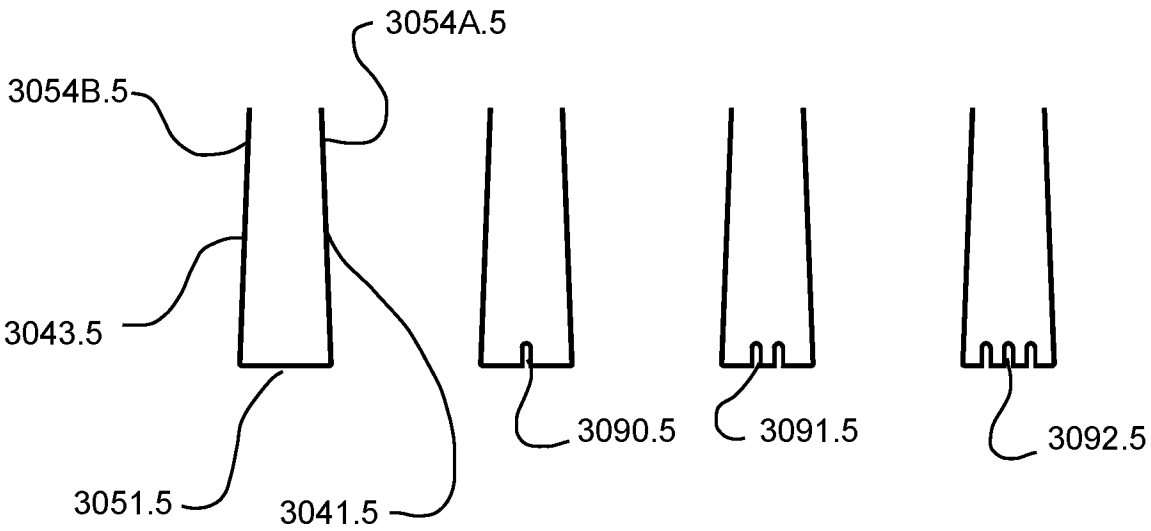
FIG. 15 shows inverted XY trapezoidal cross-sections of the system.

In FIGS. 11-15 are shown different cross sections of the three-walled members. FIG. 11 shows the XY cross-section as a trapezoid with upper XZ open plane of larger width than lower XZ base. FIG. 12 shows the XY cross-section as a square with upper open plane and lower XZ base of equal width, and right and left sides of equal width to each other as well as upper XZ plane and lower XZ base. FIG. 13 shows a XY cross-section similar to FIG. 11, but with sidewalls larger in length than in width, resembling that of a rectangle. FIG. 14 is a trapezoidal cross-section similar to FIG. 11. FIG. 15 is similar to the cross section of FIG. 14, but as an inverted trapezoid, having a lower XZ base larger than an open upper XZ plane.

Additionally shown in FIGS. 11, 12, and 13, are means for increasing the structural strength of the lower XZ base of the three-walled member. As shown in FIG. 11, element 3080.1 is a steel rod, similar to rebar, mounted directly to the bottom and elongate in the Z axis of the XZ base of the three-walled member. Similar elements 3080.2 and 3080.3 can be seen in FIGS. 12 and 13 respectively. Element 3081.1 is similar to element 3080.1, but is a steel plate elongate in the Z axis and mounted to the under-side of the lower XZ base. Element 3082.1 is a steel rod, similar to element 3080.1, but mounted to the inside lower XZ base of the three-walled member. Element 3083.1 is a u-shaped, three-walled, steel plate that is secured to the under side of the lower XZ base. Element 3084.1 is a steel plate similar to that of 3081.1, in that it is elongate in the Z axis, but is fastened to the inside lower XZ base of the three-walled member.

Each of these structural securements in FIG. 11 are present in the embodiments in FIGS. 12 and 13, that is, element 3080.1 corresponds with elements 3080.2 and 3080.3. Element 3081.1 corresponds with elements 3081.2 and 3081.3. Element 3082.1 corresponds with elements 3082.2 and 3082.3. Element 3083.1 corresponds with elements 3083.2 and 3083.3. Element 3084.1 corresponds with elements 3084.2 and 3084.3.

Shown in FIGS. 14 and 15, are different variations of ribs, elements 3090.4, 3091.4, 3092.4, 3090.5, 3091.5, 3092.5, that may be shaped within the lower XZ base of the three-walled member. These ribs offer structural securement of the member by increasing the area of the lower XZ base by giving it more surface area to distribute the stresses, which in turn gives the member a higher strength.

FIGS. 16, 17, and 18 show the system in use. FIG. 16 shows several of the three-walled members with a wire mesh 3094 over top. FIG. 17 shows a cross-section, 1-1, of the system with support pins 3080 holding up a form boards, and wire mesh 3094 over top of that. FIG. 18 shows how the cross-section will appear once the form pins and form boards are removed, exposing the concrete.

FIG. 19 further shows the system, of a first part 3040 engaging with a second part 3060 and forms a joist, which then sits on a structural support, such as a pier, beam, joist, stud, or wall. The joist forms a side elevation of a widened 'T'. The sides of the 'T' allow the joist to sit on the structural supports. In other words, the second part 3060 has elements opposite of the opening which allow the member 3060 to attach member 3040 to the structural support.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XY cross-section of said first part in the form of a trapezoid with an open upper plane;

said XY cross-section of said first part having an XZ base larger in width than a lower XZ base;

a structural securing member fastened to the lower XZ base and elongate in the Z axis; and said securing member comprises a rod secured to an underside of the lower XZ base and elongate in the Z axis.

2. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XY cross-section of said first part in the form of a trapezoid with an open upper plane;

said XY cross-section of said first part having an XZ base larger in width than a lower XZ base;

a structural securing member fastened to the lower XZ base and elongate in the Z axis; and said securing member comprises a rod secured to an inside surface of the lower XZ base and elongate in the Z axis.

3. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross section of the second part is that of the first part, but wide and tall enough to allow the first part to slip within the second pact, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XY cross-section of said first part in the form of a trapezoid with an open upper plane;

said XY cross-section of said first part having an XZ base larger in width than a lower XZ base;

a structural securing member fastened to the lower XZ base and elongate in the Z axis;

said securing member comprises a steel U-shaped plate fastened to an under side of the lower XZ base and elongate in the Z axis; and said steel U-shaped plate having a lower XZ base and two sidewalls.

4. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XY cross-section of said first part comprising three straight sides and two right angles;

the XY cross-section of said first part where all angles between the sidewalls and the lower base are at a 90 degree angle;

a structural securing member fastened to the lower XZ surface and elongate in the Z axis; and said securing member comprises a rod secured to the under side of the lower XZ base and elongate in the Z axis.

5. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross -section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XY cross-section of said first part comprising three straight sides and two right angles;

the XY cross-section of said first part where all angles between the sidewalls and the lower base are at a 90 degree angle;

a structural securing member fastener to the lower XZ surface and elongate in the Z axis; and said securing member comprises rod secured to an inside surface of the lower XZ base and elongate in the Z axis.

6. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XY cross-section of said first part comprising three straight sides and two right angles;

the XY cross-section of said first part where all angles between the sidewalls and the lower base are at a 90 degree angle;

a structural securing member fastened to the lower XZ surface and elongate in the Z axis;

said securing member comprises a steel U-shaped plate fastened to the under side of the lower XZ base and elongate in the Z axis; and said steel U-shaped plate having a lower XZ base and two side-walls.

7. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XZ cross-section in the form of an inverted trapezoid with an open upper plane;

said trapezoidal cross-section having said open upper plane lesser in width than a lower XZ base;

said trapezoidal cross-section having YZ webs greater in height dimensions to that of the width dimensions of the open upper plane and lower XZ base;

a structural securing member fastened to the lower XZ base of said first part and elongate in the Z axis; and said securing member comprises a rod secured to the under side of the lower XZ base and elongate in the Z axis.

8. A construction system definable in terms of an X, Y, and Z coordinate axes structure, the system comprising:

a first part having a hollow three-walled web elongate in the Z axis, having a series of securement brackets on the upper edges of the elongate Z axis member;

a second part having at least one open end for complemental engagement of the first part wherein the second part is adapted to fit over distal ends of said first part in which a cross section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of securement brackets extending upwardly in a positive Y direction from said upper XZ base;

said series of securement brackets having a space between each bracket;

an XZ cross-section in the form of an inverted trapezoid with an open upper plane;

said trapezoidal cross-section having said open upper plane lesser in width than a lower XZ base;

said trapezoidal cross-section having YZ webs greater in height dimensions to that of the width dimensions of the open upper plane and lower XZ base;

a structural securing member fastened to the lower XZ base of said first part and elongate in the Z axis; and said securing member comprises a rod secured to an inside surface of the lower XZ base and elongate in the Z axis.

* * * * *